US005095850A

United States Patent [19]

Komuro

[11] Patent Number: 5,095,850

[45] Date of Patent: Mar. 17, 1992

[54] DEVELOPING DEVICE

[75] Inventor: Ichiro Komuro, Yokohama, Japan

[73] Assignee: Ricoh Company, Ltd., Tokyo, Japan

[21] Appl. No.: 551,083

[22] Filed: Jul. 11, 1990

[30] Foreign Application Priority Data

Jul. 11, 1989 [JP] Japan ..... 1-178757

[51] Int. Cl.[5] ..... G03G 15/09

[52] U.S. Cl. ..... 118/657; 355/245; 355/251; 355/259

[58] Field of Search ..... 355/259, 256, 253, 252, 355/251, 250, 246, 245; 118/653, 656, 657, 661

[56] References Cited

U.S. PATENT DOCUMENTS

| | | | |
|---|---|---|---|
| 2,839,400 | 6/1958 | Moncrieff-Yeates . | |
| 3,232,190 | 2/1966 | Willmott | 355/259 |
| 4,050,413 | 9/1977 | Parker | 355/253 X |
| 4,226,524 | 10/1980 | Hashimoto | 355/253 |
| 4,327,664 | 5/1982 | Ohkawa et al. | 118/661 |
| 4,370,049 | 1/1983 | Kuge et al. | 355/251 |
| 4,373,469 | 2/1983 | Kuge et al. | 355/256 X |
| 4,378,158 | 3/1983 | Kanabe | 355/259 |
| 4,383,497 | 5/1983 | Tajima | 355/251 X |
| 4,445,771 | 5/1984 | Sakamoto et al. | 355/253 X |
| 4,480,911 | 11/1984 | Itaya et al. | 355/251 |
| 4,545,669 | 10/1985 | Hays et al. | 355/253 |
| 4,576,463 | 3/1986 | Sakamoto et al. | 355/259 X |
| 4,611,900 | 9/1986 | Folkins | 355/253 |
| 4,615,606 | 10/1986 | Nishikawa | 355/253 X |
| 4,686,934 | 8/1987 | Kohyama | 118/656 X |
| 4,777,904 | 10/1988 | Gundlach et al. | 355/259 X |
| 4,809,034 | 2/1989 | Murasaki et al. | 355/253 |
| 4,851,872 | 7/1989 | Murasaki et al. | 355/253 |
| 4,947,212 | 8/1990 | Ikegawa et al. | 355/253 X |
| 4,987,452 | 1/1991 | Nakagawa et al. | 355/253 X |

*Primary Examiner*—A. T. Grimley
*Assistant Examiner*—Sandra L. Brase
*Attorney, Agent, or Firm*—Oblon, Spivak, McClelland, Maier & Neustadt

[57] ABSTRACT

A dry-type developing device is capable of converting electrostatic latent image formed on the surface of latent image carrying member to visible image by use of developer powder, and the developing device comprises a latent image carrying member for carrying electrostatic latent image formed thereon at the respective different positions, a first developer carrying member for holding thereon two components type developer having non-magnetic toner and magnetic carrier, a second developer carrying member disposed so as to adjacently oppose the first developer carrying member and the latent image carrying member, a control device for regulating the amount of developer on the first developer carrying member, a first electric field forming device for forming a first direct-current electric field between the first and second developer carrying members, and a second electric field forming device for forming a second direct-current electric field between the latent image carrying member and the second developer carrying member.

7 Claims, 1 Drawing Sheet

DEVELOPING DEVICE

BACKGROUND OF THE INVENTION

1. Field of the Invention

The present invention relates to a dry-type developing device capable of converting an electrostatic latent image formed on the surface of a latent image carrying member to a visible image by use of developer powder.

2. Description of the Related Art

In the image forming device such as a copying machine, facsimile device, printer, etc., a dry-type developing device is widely adopted as a type of image forming device which forms electrostatic latent image on a latent image carrying body thereof and converts the latent image to a visible image.

In such a developing device as mentioned above, first and second developer carrying rollers are provided, and the first developer carrying roller carries and transports therearound two-components developer consisting of nonmagnetic toner and magnetic carrier as a magnetic brush. Toner contained in the developer constructing the magnetic brush is electrostatically sucked onto the second developer carrying roller. And further, the sucked toner on the second developer carrying roller is transported to the side of the latent image carrying body such as a photosensitive body, and thereafter the electrostatic latent image formed on the latent image carrying body is developed as a visible image. Such technology mentioned above is well known. For instance, it is disclosed in Japanese Laid-open Patent Publication No. 60-140277/1985.

In addition to the above-mentioned, there exist several prior-art documents relevant to the above technology. Both of Japanese Laid-open Patent Publications Nos. 62-279374/1987 and 62-279375/1987 disclose an improvement technology of an electrophotographic device having a first roll for developing electrostatic latent image and a second roll for supplying the developer to the first roll.

Japanese Laid-open Patent Publication No. 56-40862/1981 relates to an electrophotographic developing device by use of one-component developer capable of coating uniformly the surface of the developing roller with toner, improving the clearness of the developed image without any developing uniformity, and obtaining the visible image having sufficient halftone characteristic.

On the other hand, Japanese Laid-open Patent Publication No. 56-126870/1981 relates to an improvement of the so-called jumping developing device in which one-component magnetic developer is applied onto the surface of the developer carrier in a state of thin layer and the thin layer surface of the developer is put adjacent to the surface of the member to be developed having electrostatic latent image so that the developer flies (jumps) toward the surface of the member to be developed from the developer thin layer by the action of electric force exerted by the latent image.

In the developing device as mentioned, for instance, in the Japanese Laid-open Patent Publication No. 60-140277/1985, when the magnetic brush formed on the first developer carrying roller frictionally slides on the surface of the second developer carrying roller, toner contained in the developer for constructing the magnetic brush is electrostatically attached to the second developer carrying roller.

However, on this occasion, a streaked portion with the thinning thickness of the toner layer which is the "so-called brush mark" is created on the second developer carrying roller by frictionally sliding on the surface of the second developer carrying roller.

Consequently, it turns out to be difficult to make uniform the toner layer on the surface thereof.

Especially, in relation to the developing device of the type in which the operation of developing is performed by causing the toner to fly without bringing the toner layer on the second developer carrying roller into contact with the surface of the latent image carrying member, it may be absolutely necessary to make the thickness of the toner layer on the second developer carrying roller. In other words, if the surface of the toner layer is not uniform, namely if it is in a state of undulation, surges or the like, the quality of the developed image may be apt to be deteriorated.

SUMMARY OF THE INVENTION

In the aforementioned related art, there have been raised several points at issue regarding the developing device, for instance, that the change of the thickness of the toner layer on the developer carrying roller such as undulation, surges or the like exerts an influence directly upon the image to be formed, so that the quality of the developed image may be apt to be deteriorated.

It is an object of the present invention to remove the above-mentioned conventional defects.

It is another object of the present invention to provide a developing device in which the occurrence of the brush mark is suppressed and further the toner layer can be formed on the second developer carrying member so as to make the thickness thereof constant and uniform, in order to remove the abovementioned conventional defects.

The above-mentioned objects can be attained by the developing device according to the present invention.

DESCRIPTION OF THE PREFERRED EMBODIMENT

Figure 1:
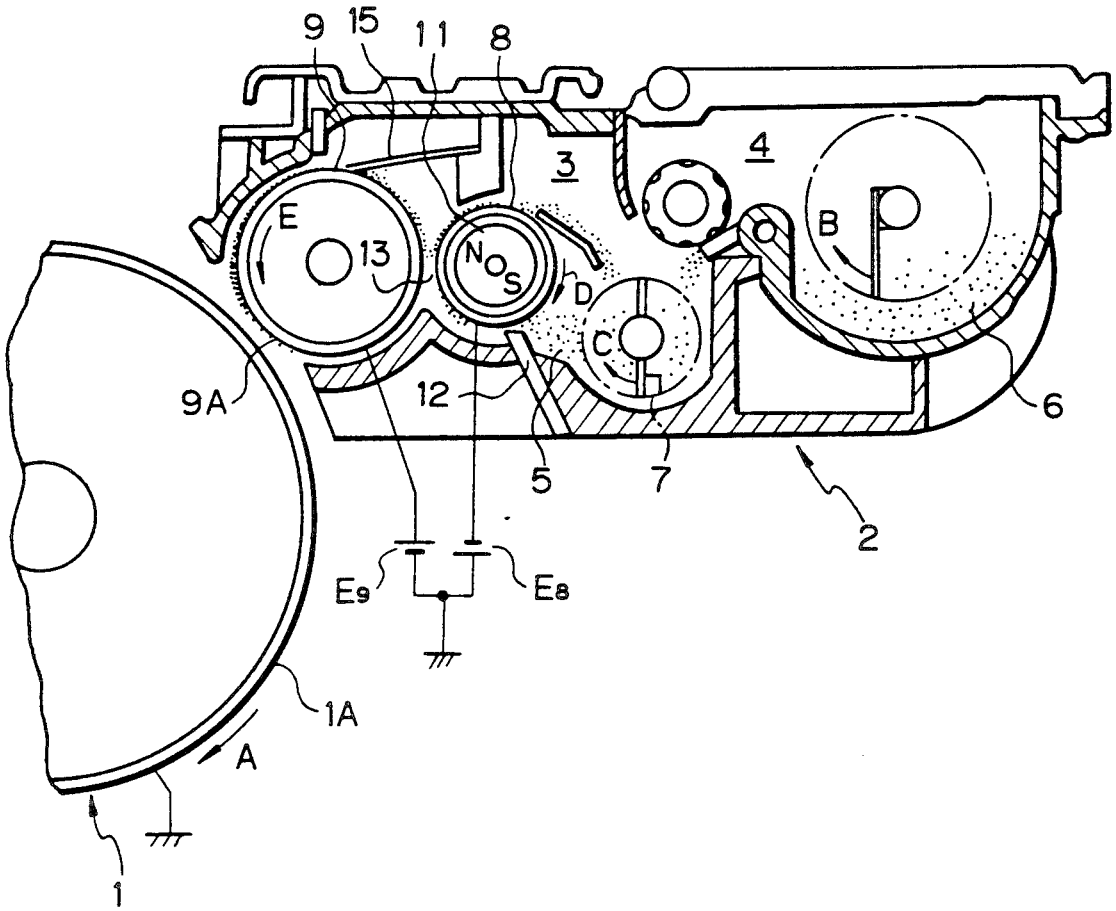
FIG. 1 is an outlined construction view showing a developing device of an embodiment according to the present invention.

In order to attain the aforementioned objects, a developing device according to the present invention capable of converting electrostatic latent image formed on the surface of latent image carrying member to visible image by use of developer powder is characterized in that the developing device comprises:

- a latent image carrying member for carrying electrostatic latent image formed thereon at the respective different positions;
- a first developer carrying member for holding thereon two-components type developer having non-magnetic toner and magnetic carrier and transporting the developer in a circumferential direction of the carrying member as a magnetic brush;
- a second developer carrying member disposed so as to adjacently oppose to the first developer carrying member and the latent image carrying member;
- control means for regulating the amount of developer on the first developer carrying member such that a magnetic brush disposed on the first developer carrying member does not come into contact with the second developer carrying member;

first direct-current electric field forming means for forming a first direct-current electric field between the first and second developer carrying members, the first direct-current electric field causing toner in developer constructing the magnetic brush disposed on the first developer carrying member to fly toward the side of the second developer carrying member by the action of electrostatic force and to deposit on the second developer carrying member; and second direct-current electric field forming means for forming a second direct-current electric field between the latent image carrying member and the second developer carrying member, the second direct-current electric field causing toner on the second developer carrying member to fly toward the side of the latent image carrying member by the action of electrostatic force and thereby forming latent image thereon.

The preferred embodiment according to the present invention is described hereinafter, referring to the drawings attached hereto.

In FIG. 1, a drum-shaped photosensitive body 1 constructing a part of the latent image carrying member has a photosensitive layer IA on the surface thereof. The photosensitive body I is rotatably supported on the side plate of the main body of the image forming device not shown in FIG. 1 and rotatably driven in a direction shown by an arrow A.

A developing device 2 of the above-mentioned embodiment is disposed so as to adjacently oppose the photosensitive body 1, and non-magnetic toner and two-components type developer 5 having magnetic carrier are accommodated in a developing chamber 3 of the developing device 2.

When the density of the toner in the developer is decreased, the toner 6 is replenished from a toner replenishing chamber 4. The replenished toner is uniformly agitated with the developer by use of the agitating member 7. At this time, the carrier and the toner are frictionally charged in the opposite polarities to each other, and the toner is electrostatically attached around the carrier.

The above-mentioned agitation is performed by the action of the rotation of the agitating member 7, and the developer is drawn up (pumped up) at the same time and the drawn-up developer is supplied to the circumferential surface of a developer supplying roller 8. The developer supplying roller constructs a part of the first developer carrying member and comprises a magnet member 11 having a plurality of magnetic poles arranged in a direction of the circular circumference thereof in the interior of the non-magnetic cylindrical sleeve of the magnet member 11.

In case that the developer supplying roller 8 or the magnet member 11 rotates or both of them rotate relatively to each other, the supplied developer is carried on the circumference of the developer supplying roller 8 and a magnetic brush is formed in the circumferential direction of the developer supplying roller 8. The developer is carried by use of such construction as mentioned above. In the embodiment of the present invention is carried in order in directions shown by arrows B, C, D and E, as shown in FIG. 1.

The reference numeral 9 represents a developing roller which is an exemplary construction of a second developer-carrying member. The developing roller 9 rotates in a counterclockwise direction shown by the arrow E in FIG.1. The entire portion of the developing roller 9 is made of an electrically conductive material (such as metal). Otherwise, an electrically conductive layer 9A is formed on the circular circumferential surface of the developing roller 9. And further, the developing roller 9 is disposed so as to adjacently oppose to, respectively, the developer supplying roller 8 and the photosensitive body 1, at the respective different positions. Namely, according to the embodiment of the present invention, the developing roller 9 is opposed to the photosensitive body i and the developer supplying roller 8, both of which are located at the positions opposite to each other from the developing roller 9.

The reference numeral 12 represents a developer regulating blade. The blade 9 constructs a part of means for regulating the amount of the developer, which shovels (clears away) the surplus developer of the developer supplying roller 8 such that the magnetic brush situated on the circumferential surface of the developer supplying roller 8 does not come into contact with the circumferential surface of the developing roller 9.

Figure 2:
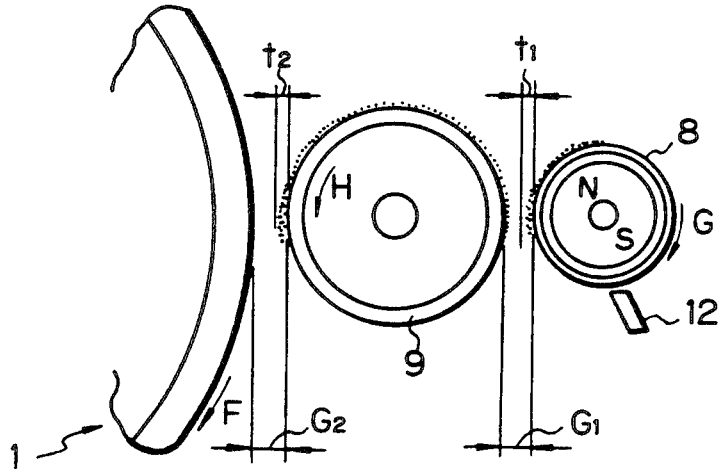
FIG. 2 is an explanatory view for explaining the relative position of the photosensitive body, the developing roller and the developer supplying roller.

Now, in FIG. 2, assuming that the gap between the developing roller 9 and the developer supplying roller 8 is G1 and the thickness of the developer layer on the developer supplying roller 8 is regulated to t1 by cutting the ear (spike) of the magnetic brush by use of the developer regulating blade 12, a condition of (G1 - t1) $>0$ is established.

On the other hand, a DC (direct-current) electric field for electrostatically flying only the toner in the developer constructing the magnetic brush formed on the developer supplying roller 8 toward the side of the developing roller 9 and depositing the toner thereon is formed between the developing roller 9 and the developer supplying roller 8 by use of the means as mentioned below.

Namely, according to this means, DC bias voltage are respectively applied to the developing roller 9 and the other developer supplying roller 8, respectively, from the DC electric power source E9 and the other DC electric power source E8.

In the embodiment of the present invention, the carrier and the toner attached therearound are, respectively, positively and negatively charged. On this occasion, negative DC bias voltage is applied to the developer supplying roller 8 and positive DC bias voltage is applied to the developing roller 9.

By the action of such electric field, the toner is separated from the carrier in the developer on the developer supplying roller 8 and the separated toner is electrostatically flown toward the developing roller 9 and deposited thereon. Such giving-and-taking (delivery-and-receipt) of the toner is performed in the neighboring area 13 between the developing roller 9 and the developer supplying roller 8. The toner which is transferred to the developing roller 9 and carried on the roller 9 regulates the toner layer and makes uniform the thickness thereof by use of the blade 15 as an example of the means for making uniform the thickness of the toner layer.

On this occasion, as is the case of the conventional magnetic brush type developing device employing two-components system developer, since only the sufficiently charged toner in the mixture of insufficiently charged toner and sufficiently charged toner is sucked toward the developing roller 9, the background of the image can be prevented from dirt occurrence thereof, and consequently the quality of image to be reproduced turns out to be improved.

Hereupon, in FIG. 2, assuming that the gap between the photosensitive body i and the developing roller 9 is G2 and the thickness of the toner layer on the developing roller 9, the positional relationship of the photosensitive body 1 and the developing roller 9 and the thickness of the toner layer on the developing roller 9 are established (set) so as to get a condition of "(G2 - t2) >0". In such a way, the toner layer on the developing roller 9 can be located on a position where the developing roller 9 does not come into contact with the surface of the photosensitive body I. Moreover, the electric field applied to the space between the developing roller 9 and the developer supplying roller 8 is strengthened or weakened so that the amount of the toner flying from the developer supplying roller 8 to the developing roller 9 is changed (increased and decreased, respectively).

In such a way, the thickness of the toner layer satisfying the condition as mentioned above can be established.

In FIG. 1, a DC electric field is formed in the space between the photosensitive body 1 and the developing roller 9 so as to electrostatically fly the toner on the developing roller 9 toward the side of the photosensitive body 1 and transfer the toner to the electrostatic latent image formed on the photosensitive body 1.

Now, supposing that the photosensitive body 1 has a characteristic of being positively charged, the surface of the photosensitive body 1 is charged, for instance, positively at the electric potential of several hundreds voltage (for instance, +800v) at the time of charging the photosensitive body 1. And further, the portion having thereon the image formed by the well-known exposing method keeps an electric potential of several hundreds voltage. An electric field transferring the toner of negative polarity on the developing roller 9 is created between the photosensitive portion having such electric potential of several hundreds voltage and the developing roller 9 to which a DC bias voltage of positive polarity (for instance, +200v) is applied by the DC electric power source E9.

In the end, the toner on the developing roller 9 isolated from the surface of the photosensitive layer IA formed on the photosensitive body 1 by such electric field forming means with the gap of an amount (G2-t2) flies toward the side of the surface of the photosensitive body 1 and is deposited on the image portion of the electrostatic latent image. In such manner as mentioned above, the electrostatic latent image is developed into a visible image.

Moreover, the present invention can be widely applied to the various developing devices for use in the image forming device employing a drum-shaped photosensitive body or a belt-shaped photosensitive body as the latent image carrying member, and the other image forming device employing the latent image carrying member excluding the photosensitive body as mentioned above, or the like.

The functional effect of the present invention is as described below.

Since the developing device according to the present invention does not have a construction in which the magnetic brush made by the developer and formed on the first developer carrying member is frictionally sliding on the second developer carrying member, and thereby the toner is deposited on the second developer carrying member, no brush mark appears on the toner layer of the second developer carrying member.

Consequently, the thin toner layer of uniform thickness can be formed on the second developer carrying member, and therefore the image of good quality can be obtained stably almost without creating an unevenness in density, etc.

And further, similarly, since the developing device according to the present invention does not adopt the developing system of performing the operation of developing by frictionally sliding the toner of the second developer carrying member on the latent image carrying member, it may be possible to suppress the occurrence of the image influenced by the aforementioned brush mark or the like.

What is claimed as new and desired to be secured by letters patent of the United States is:

1. A developing device capable of converting an electrostatic latent image formed on the surface of a latent image carrying member to a visible image by use of developer powder comprising:

a latent image carrying member for carrying an electrostatic latent image formed thereon at the respective different positions;

a first developer carrying member for holding thereon two-components type developer having non-magnetic toner and magnetic carrier and transporting said developer in a circumferential direction of said first developer carrying member as a magnetic brush;

a negative electric power source connected to said first developer carrying member for supplying negative bias voltage to said first developer carrying member;

a second developer carrying member disposed so as to adjacently oppose said first developer carrying member and said latent image carrying member;

a positive electric power source connected to said second developer carrying member for supplying positive bias voltage to said second developer carrying member; and control means for regulating the amount of developer on said first developer carrying member such that a magnetic brush disposed on said first developer carrying member does not come into contact with said second developer carrying member;

said negative and positive electric power sources forming a first direct current electric field between aid first and second developer carrying members, said first electric field causing toner in developer constructing said magnetic brush disposed on said first developer carrying member to fly toward the side of said second developer carrying member by the action of electrostatic force and to deposit on said second developer carrying member; said negative and positive electric power sources also forming a second direct current electric field between said latent image carrying member and said second developer carrying member, said second electric field causing toner on said second developer carrying member to fly toward the side of said latent image carrying member by the action of electrostatic force and thereby converting electrostatic latent image formed thereon to a visible image.

2. A developing device as defined in claim 1, in which a photosensitive body is employed as said latent image carrying member.

3. A developing device as defined in claim 2, in which said latent image carrying member is a drum-shaped photosensitive body.

4. A developing device as defined in claim 2, in which said latent image carrying member is a belt-shaped photosensitive body.

5. A developing device as defined in claim 1, wherein said developing device is dry-type.

6. A developing device as defined in claim 1, wherein said developing device is wet-type.

7. A developing device as defined in claim 1, wherein said second developer carrying member carries toner in a state of thin layer.

* * * * *